United States Patent [19]

Gerzon

[11] 4,139,729

[45] Feb. 13, 1979

[54] SOUND REPRODUCTION SYSTEM WITH MATRIXING OF POWER AMPLIFIER OUTPUTS

[75] Inventor: Michael A. Gerzon, Oxford, England

[73] Assignee: National Research Development Corporation, London, England

[21] Appl. No.: 809,634

[22] Filed: Jun. 24, 1977

[30] Foreign Application Priority Data

Jul. 1, 1976 [GB] United Kingdom ..... 27363/76

[51] Int. Cl.[2] ..... H04R 5/00

[52] U.S. Cl. ..... 179/1 GQ

[58] Field of Search ..... 179/1 GQ, 1 G, 1 GP, 179/15 BT, 100.1 TD, 100.4 ST

[56] References Cited

U.S. PATENT DOCUMENTS

| | | | |
|---|---|---|---|
| 3,824,342 | 7/1974 | Christensen et al. | 179/1 GQ |
| 3,892,917 | 7/1975 | Sotome | 179/1 GQ |
| 3,906,156 | 9/1975 | Cooper | 179/1 GQ |
| 3,958,085 | 5/1976 | Barber et al. | 179/1 GQ |
| 3,997,725 | 12/1976 | Gerzon | 179/1 GQ |

*Primary Examiner*—Douglas W. Olms

*Attorney, Agent, or Firm*—Cushman, Darby & Cushman

[57] ABSTRACT

In a surround sound reproduction system the required number of power amplifiers is reduced by effecting at least part of the decoding operation by the manner in which the various loudspeakers are connected to the outputs of the power amplifiers while preserving linear independence of the signals fed to every set of three loudspeakers. In one embodiment, the loudspeakers are grouped in pairs such that the sum of signals fed to the loudspeakers of each pair is the same for all of the pairs, a first amplifier is arranged to receive said signal and a respective second amplifier for each pair of loudspeakers is arranged to receive the signal to be fed to one of the loudspeakers of such pair, the second loudspeaker of each pair being connected between the output of the corresponding second amplifier and the output of the first amplifier. In another embodiment, the number of loudspeakers is one greater than the number of power amplifiers, one loudspeaker is connected between earth and a common terminal and the other loudspeakers are connected between the common terminal and the output of a respective amplifier.

8 Claims, 4 Drawing Figures

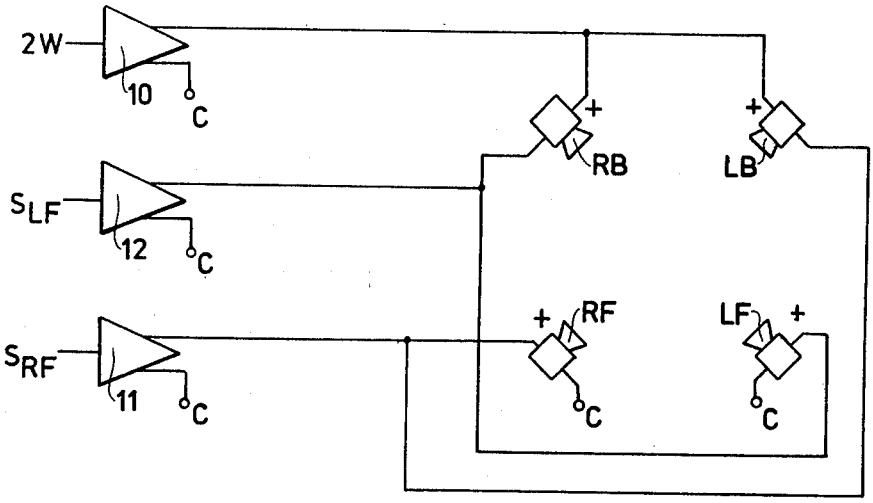
—FIG.1—
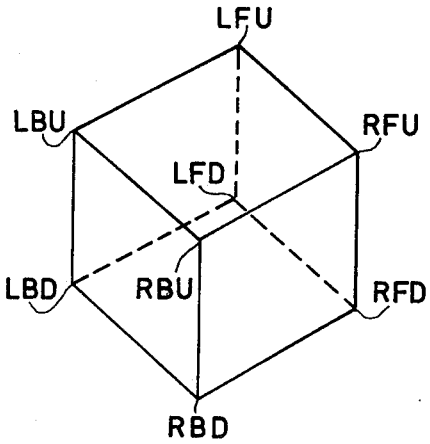
—FIG.2—

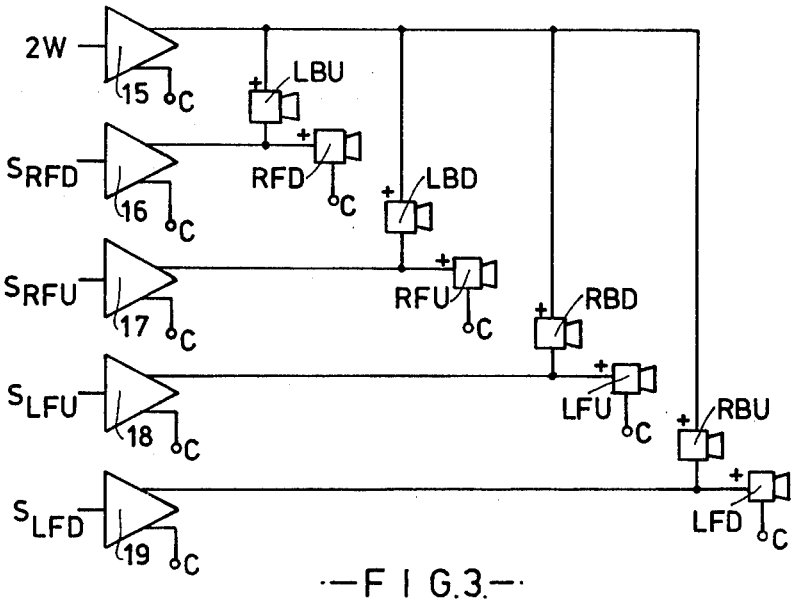
—FIG.3.—
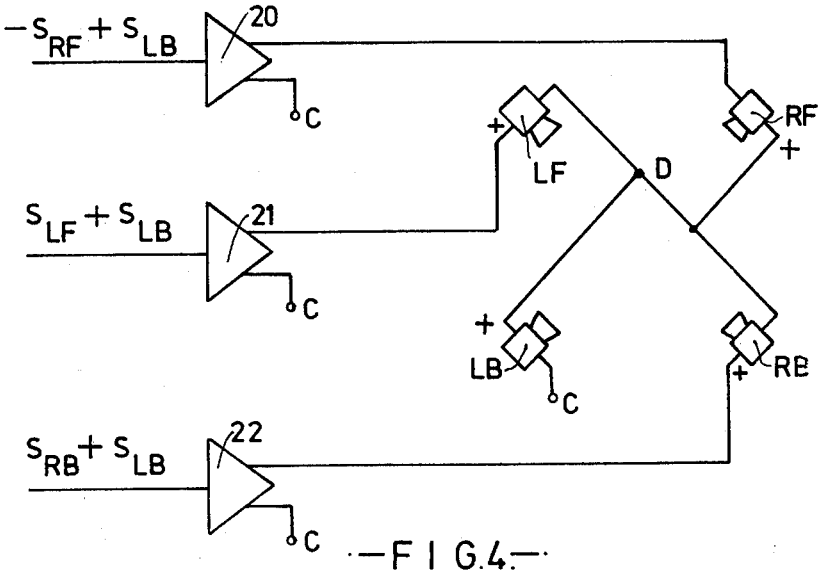
—FIG.4.—

SOUND REPRODUCTION SYSTEM WITH MATRIXING OF POWER AMPLIFIER OUTPUTS

FIELD OF THE INVENTION

This invention relates to surround sound reproduction systems of the type which enable a listener to distinguish sound from sources extending over 360° of azimuth, and is also applicable to systems which, in addition, enable the listener to distinguish sound from sources of different heights. The invention is particularly concerned with the provision of a decoder for such a system in which at least part of the decoding operation is effected by the manner in which the various loudspeakers are connected to the outputs of the power amplifiers.

BACKGROUND OF THE INVENTION

Sound reproduction systems in which decoding or matrixing is carried out by the manner in which the loudspeakers are connected to the outputs of power amplifiers are disclosed in Gerzon "Surround Sound from 2-Channel Stereo", Hi-Fi News, August 1970, page 1104 and Hafler, "2-Channel Quadraphony", Hi-Fi News, August 1970, page 1111. However, in these previous proposals, there exists at least one set of three loudspeakers for which there is a non-zero linear combination of their voltages. In other words the signals fed to such a set of three loudspeakers are not linearly independent and it has been found that such linear independence is desirable if authentic directional reproduction is to be achieved.

SUMMARY OF THE INVENTION

According to the invention, there is provided a decoder for a surround sound reproduction system comprising at least three power amplifiers, each of which is arranged to produce an output signal between a respective pair of power output terminals, and respective pairs of decoder output terminals for connection to a number of loudspeakers greater than the number of power amplifiers, the decoder output terminals being connected either to decoder output terminals of other pairs or to power output terminals of said power amplifiers by electrical connection means of substantially zero-impedence, the arrangement being such that, during reproduction of surround sound, the voltages produced across every group of three pairs of decoder output terminals are linearly independent of one another.

The term "linearly independent" means that, if $V_1$, $V_2$ and $V_3$ are the voltage signals applied to any three of the loudspeakers, then there are no real non-zero values of $a_1$, $a_2$ and $a_3$ such that at all times:

$$a_1 V_1 + a_2 V_2 + a_3 V_3 = 0$$

When the invention is to be applied to a sound reproduction system having an array of pairs of loudspeakers such that the sum of signals fed to the loudspeakers of each pair is the same for all of the pairs, the decoder may comprise a first amplifier arranged to receive said sum signal and a respective second amplifier for each pair of loudspeakers arranged to receive the signal to be fed to one of the loudspeakers of such pair, the first power output terminals of each amplifier being connected to each other, the first pair of decoder output terminals for each pair of loudspeakers being connected to the power output terminals of the corresponding second amplifier and the second pair of output terminals for each pair of loudspeakers being connected between the second power output terminal of said corresponding second amplifier and the second power output terminal of the first amplifier.

In another form of invention, for use with a loudspeaker array in which the number of loudspeakers is one greater than the number of power amplifiers, one of the decoder output terminals of one pair is connected to one power output terminal of each of the power amplifiers, one of the decoder output terminals of each of the other pairs is connected to the other power output terminal of a respective one of the power amplifiers and the other decoder output terminals are connected to each other.

When two or more terminals are stated to be interconnected, they may of course be replaced by a common terminal.

BRIEF DESCRIPTION OF THE DRAWINGS

Embodiments of the invention, applied to rectangular and cuboid loudspeaker layouts, will now be described by way of example with reference to the accompanying drawings, in which:

FIG. 1 is a schematic diagram of a rectangular loudspeaker array and a decoder for use therewith, FIG. 2 is a schematic diagram illustrating the locations of loudspeakers in a cuboid array, FIG. 3 is a schematic diagram of a decoder for feeding loudspeakers at the locations shown in FIG. 2, and FIG. 4 is a schematic diagram of an alternative decoder for use with a rectangular loudspeaker array.

DESCRIPTION OF THE PREFERRED EMBODIMENT

Referring to FIG. 1, four loudspeakers LF, RF, LB and RB are disposed at the left front, right front, left back and right back positions respectively surrounding a listening area. The positive phase terminals of the loudspeakers are marked "+". The input signals comprise two signals $S_{LF}$ and $S_{RF}$ intended to be heard from the loudspeakers LF and RF respectively, together with a signal 2W given by $$2W = S_{LF} + S_{RB} = S_{RF} + S_{LB}$$

where $S_{LB}$ and $S_{RB}$ are the signals intended to be heard from the left back and right back loudspeakers LB and RB respectively. The input signals 2W, $S_{RF}$ and $S_{LF}$ are applied to respective amplifiers 10, 11 and 12. One output terminal of each amplifier is connected to a common terminal C which may be, but is not necessarily, connected to earth. The loudspeakers RF and LF are connected between the other live output terminals of the amplifiers 11 and 12 respectively and the common terminal C. The loudspeaker LB is connected between the live output terminal of the amplifier 10 and the second output terminal of the amplifier 11 while the loudspeaker RB is connected between the second output terminal of the amplifier 10 to the second output of the amplifier 12. Thus the signal applied to the loudspeaker LB is given by $$2W - S_{RF} = (S_{LB} + S_{RF}) - S_{RF} = S_{LB}$$

Similarly, the signal applied to the loudspeaker RB is given by $$2W - S_{LF} = (S_{RB} + S_{LF}) - S_{LF} = S_{RB}$$

Referring to FIG. 2, eight loudspeakers RFD, LFU, RFU, LFD, LBU, RBU, RBD and LBD are disposed at respective corners of a cuboid enclosing a listening location. Referring to FIG. 3, these eight loudspeakers are fed from five amplifiers 15, 16, 17, 18 and 19. The amplifier 15 is fed with a signal 2W given by $$2W = S_{LFU} + S_{RBD}$$

$$2W = S_{RFU} + S_{LBD}$$

$$2W = S_{LFD} + S_{RBU}$$

$$2W = S_{RFD} + S_{LBU}$$

The remaining amplifiers 16 to 19 are fed with signals $S_{RFD}$, $S_{RFU}$, $S_{LFU}$ and $S_{LFD}$ which are the signals to be applied to the loudspeakers RFD, RFU, LFU and LFD respectively. The manner of connection to the loudspeakers is equivalent to that illustrated in FIG. 1, the outputs of each of the amplifiers 16 to 19 being connected to the loudspeakers corresponding to the inputs signals applied to such amplifiers. Each of the remaining loudspeakers is connected between the output of the amplifier supplying the corresponding diagonally opposite loudspeaker and the output of the amplifier 16.

An arrangement similar to those shown in FIGS. 1 and 3 can be applied to systems involving any number of pairs of loudspeakers provided that the sum of the signals to be applied to each diagonally opposite pair is equal to the sum of the signals to be applied to each of the other diagonally opposite pairs. For the i'th pair of loudspeakers, the signals applied to the two loudspeakers of the pair are $S_i^+$ and $S_i^-$ where $S_i^- = 2W - S_i^+$.

Since the power amplifier carrying the 2w signal is connected to substantially more loudspeakers than any other amplifier, it may, as a matter of practical convenience, be replaced by a plurality of identical amplifiers, each feeding a respective group of pairs of loudspeakers.

FIG. 4 shows an alternative decoder for feeding the four loudspeakers LF, RF, LB and RB. The input signals comprise three signals $(-S_{RF} + S_{LB})$, $(S_{LF} + S_{LB})$ and $(S_{RB} + S_{LB})$. These signals are applied to respective amplifiers 20, 21 and 22 each of which has one output terminal connected to a common terminal C which may be, but is not necessarily, connected to earth. The loudspeaker LB has its negative phase terminal connected to the common terminal C and its positive phase terminal connected to a point D which is also connected to the negative phase terminals of the loudspeakers LF and RB and to the positive phase terminal of RF. The other terminals of the loudspeakers RF, LF and RB are connected to the second input terminal of the amplifiers 20, 21 and 22 respectively. It will be seen that the voltage on point D, with respect to the common terminal C, is given by $$S_D + \tfrac{1}{4}\{(-S_{RF} + S_{LB}) + (S_{LF} + S_{LB}) + (S_{RB} + S_{LB}) + 0\} = +S_{LB} + \tfrac{1}{4}\{S_{LF} - S_{RF} + S_{RB} - S_{LB}\}$$

but $$S_{LF} - S_{RF} + S_{RB} - S_{LB} = 0$$

therefore $$S_D = +S_{LB}$$

thus the signal $S_{LB}$ is supplied to the loudspeaker LB and the signals applied to the other three loudspeakers are as follows $(S_{LF} + S_{LB}) - S_{LB} = S_{LF}$ for the loudspeaker LF $-(-S_{RF} + S_{LB}) + S_{LB} = S_{RF}$ for the loudspeaker RF $(S_{RB} + S_{LB}) - S_{LB} = S_{RB}$ for the loudspeaker RB An arrangement similar to that shown in FIG. 4 may be used to feed more than four loudspeakers using one fewer power amplifiers than the number of loudspeakers. In general, if m + 1 loudspeakers are to feed from m power amplifiers, the (m + 1)'th loudspeaker has one of its terminals connected to the interconnected common output terminals of the power amplifiers and the other of its terminals connected to one of the terminals of each of the other loudspeakers, each of which has its other terminal connected to the second output of a respective power amplifier. If the signal voltage desired across the terminals of the i'th loudspeaker is $S_i$, and if $S_1 + S_2 + \ldots + S_{m+1} = 0$, then the signal $S_i - S_{m+1}$ is fed to the i'th power amplifier for i = 1,2,...,m. This ensures that the potential of said first terminal of the (m+1)'th loudspeaker is $S_{m+1}$ above that of said second terminal, and that the potentials with respect to said second terminal across the i'th loudspeaker is $S_i$. In the four loudspeaker case described above with reference to FIG. 4, we have $S_1 = -S_{RF}$, $S_2 = S_{LF}$, $S_3 = S_{RB}$ and $S_4 = -S_{LB}$.

It may be shown that the voltages across any chosen three pairs of loudspeakers in any of the embodiments of the invention described above are linearly independent provided that there exists a pair of signals X and Y such that the signals W, X and Y are linearly independent and the signal at any loudspeaker is given by $$S_i = W + b_i X + c_i Y$$

where $b_i$ and $c_i$ are non-zero real coefficients and the ratio $b_i : c_i$ is unique for each loudspeaker. This condition is sufficient to ensure the required linear independence but such independence can be achieved in other ways.

It should be understood that systems are within the scope of the invention if there exist at least four loudspeakers meeting the requirements for linear independence even if there are other loudspeakers which do not meet the requirements. For example a third loudspeaker may be connected between the positive terminals of the loudspeakers LF and RF of FIG. 1 and thus be fed with a combination of the signals $S_{LF}$ and $S_{RF}$.

I claim:

1. A decoder for a surround sound reproduction system comprising at least three power amplifiers, each of which is arranged to produce an output signal between a respective pair of power output terminals, a predetermined number of pairs of decoder output terminals greater than the number of power amplifiers, each pair of decoder output terminals being associated with and adapted for connection to an associated loudspeaker, passive electrical connection means of substantially zero-impedance, for selectively connecting said decoder output terminals to other decoder output terminals, and said amplifier power output terminals to produce, during reproduction of surround sound, voltages across every group of three pairs of decoder output terminals which are linearly independent of one another.

2. A decoder according to claim 1, for a sound reproduction system having an array of pairs of loudspeakers, and adapted for feeding a respective signal to each loudspeaker such that the sum of the signals fed to the loudspeakers of each pair is the same for all of the pairs, the decoder comprising:

a first amplifier arranged to receive a sum signal indicative of the sum of the signals fed to the loudspeakers of each pair and a respective second amplifier associated with each pair of loudspeakers arranged to receive the signal to be fed to one of the loudspeakers of such associated pair, said passive electrical connection means comprising means for connecting the first power output terminals of each amplifier to each other, means for connecting one pair of decoder output terminals associated with each pair of loudspeakers to the power output terminals of the corresponding second amplifier and means for connecting the second pair of decoder output terminals associated with each pair of loudspeakers between the second power output terminal of said corresponding second amplifier and the second power output terminal of the first amplifier.

3. A decoder according to claim 1, for a loudspeaker array in which the number of loudspeakers is one greater than the number of power amplifiers wherein said passive electrical connection means comprises means for connecting one decoder output terminal of one pair of the decoder output terminals to one power output terminal of each pair of amplifier power output terminals, means for connecting one of the decoder output terminals of each of the others of said pairs of decoder output terminals to the other of the pair of power output terminals of respective ones of the power amplifiers and means for connecting the remaining decoder output terminals to each other.

4. A reproducer for a surround sound reproduction system, having a decoder comprising:

at least three power amplifiers, each of which is arranged to produce an output signal between a respective pair of power output terminals, a predetermined number of loudspeakers greater than the number of amplifiers, respective pairs of decoder output terminals, each pair of decoder output terminals being associated with and connected to one of said loudspeakers; and passive electrical connection means of substantially zero-impedance, for selectively connecting said decoder output terminals to each other and to said amplifier power output terminals to produce during reproduction of surround sound, respective voltages across every group of three pairs of decoder output terminals which are linearly independent of one another.

5. A reproducer according to claim 4, having an array of pairs of loudspeakers, and adapted for feeding a respective signal to each loudspeaker such that the sum of signals fed to the loudspeakers of each pair is the same for all of the pairs, said decoder comprises:

a first amplifier arranged to receive a signal indicative of said sum of signals fed to the loudspeakers of each pair and a respective second amplifier associated with each pair of loudspeakers arranged to receive the signal to be fed to one of the loudspeakers of such associated pair, said passive electrical connection means comprising means for connecting the first power output terminals of each amplifier to each other, means for connecting one pair of decoder output terminals associated with each pair of loudspeakers to the power output terminals of the corresponding second amplifier and means for connecting the second pair of decoder output terminals associated with each pair of loudspeakers between the second power output terminal of said corresponding second amplifier and the second power output terminal of the first amplifier.

6. A reproducer according to claim 4, for a loudspeaker array in which the number of loudspeakers is one greater than the number of power amplifiers wherein said passive electrical connection means comprises means for connecting one decoder output terminal of one pair of the decoder output terminals to one power output terminal of each pair of amplifier power output terminals, means for connecting one of the decoder output terminals of each of the others of said pairs of decoder output terminals to the other of the pair of power output terminals of respective ones of the power amplifiers and means for connecting the remaining decoder output terminals to each other.

7. A reproducer according to claim 4, comprising four loudspeakers disposed at respective corners of a rectangle.

8. A reproducer according to claim 4, comprising eight loudspeakers disposed at respective corners of a cuboid.

* * * * *